US010144615B2

(12) United States Patent
Prakash

(10) Patent No.: US 10,144,615 B2
(45) Date of Patent: Dec. 4, 2018

(54) JOLT-FREE ELEVATOR POWER TRANSITION

(71) Applicant: Otis Elevator Company, Farmington, CT (US)

(72) Inventor: Om Prakash, Pune (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/128,740

(22) PCT Filed: Mar. 23, 2015

(86) PCT No.: PCT/US2015/021965
§ 371 (c)(1),
(2) Date: Sep. 23, 2016

(87) PCT Pub. No.: WO2015/148359
PCT Pub. Date: Oct. 1, 2015

(65) Prior Publication Data

US 2017/0107077 A1 Apr. 20, 2017

(30) Foreign Application Priority Data

Mar. 24, 2014 (IN) ..... 843/DEL/2014

(51) Int. Cl.
*B66B 5/02* (2006.01)
*B66B 1/30* (2006.01)

(52) U.S. Cl.
CPC ..... *B66B 5/027* (2013.01); *B66B 1/30* (2013.01); *B66B 5/024* (2013.01)

(58) Field of Classification Search
CPC ..... B66B 5/027; B66B 1/30; B66B 5/024
USPC ..... 187/290
See application file for complete search history.

(56) References Cited

U.S. PATENT DOCUMENTS 4,484,664 A 11/1984 Nomura
5,058,710 A * 10/1991 Iwasa ..... B66B 5/02 187/290
5,285,029 A * 2/1994 Araki ..... B66B 5/027 187/290

(Continued)

FOREIGN PATENT DOCUMENTS

CN 1224566 C 10/2005
JP H07232872 A 9/1995
WO WO 2008100259 A1 * 8/2008 ..... B66B 1/302

OTHER PUBLICATIONS

International Search Report and Written Opinion for application PCT/US2015/021965, dated Jun. 26, 2015, 12 pages.

(Continued)

*Primary Examiner* — David Warren
(74) *Attorney, Agent, or Firm* — Cantor Colburn LLP

(57) ABSTRACT

Embodiments are directed to a converter configured to supply power to a motor of an elevator, a first power source coupled to the converter and configured to provide input power to the converter, and a second power source selectively coupled to the converter and configured to provide input power to the converter when power from the first power source is unavailable and when an elevator car of the elevator is moving, wherein a speed of the elevator car remains substantially constant when a transition in terms of the input power to the converter is made from the first power source to the second power source.

19 Claims, 3 Drawing Sheets

(56) References Cited

U.S. PATENT DOCUMENTS 5,896,948 A * 4/1999 Suur-Askola ..... B66B 1/30 187/290
6,075,331 A * 6/2000 Ando ..... H02J 7/345 307/48
6,173,814 B1 * 1/2001 Herkel ..... B66B 1/34 187/248
6,460,658 B2 * 10/2002 Suga ..... B66B 1/30 187/290
6,742,630 B2 * 6/2004 Eilinger ..... B66B 1/30 187/290
6,938,733 B2 * 9/2005 Eilinger ..... B66B 5/02 187/290
7,275,622 B2 10/2007 Hall
7,331,426 B2 * 2/2008 Jahkonen ..... B66B 1/302 187/290
7,681,694 B2 * 3/2010 Aulanko ..... B66B 1/308 187/277
8,172,042 B2 * 5/2012 Wesson ..... B66B 1/302 187/290
8,177,033 B2 * 5/2012 Kauppinen ..... B66B 1/30 187/290
8,471,403 B2 * 6/2013 Kahkipuro ..... B66B 1/302 187/247
9,481,549 B2 * 11/2016 Ishiguro ..... B66B 1/302
2004/0035646 A1 2/2004 Araki
2008/0073157 A1 * 3/2008 Kanon ..... B66B 5/027 187/290
2010/0000825 A1 1/2010 Smith et al.
2010/0006378 A1 * 1/2010 Blasko ..... B66B 1/30 187/290
2010/0026244 A1 * 2/2010 Iida ..... B66B 5/027 320/134
2010/0096931 A1 * 4/2010 Jahkonen ..... B66B 1/30 307/80
2010/0258383 A1 * 10/2010 Saarikoski ..... B66B 1/34 187/290
2011/0144810 A1 * 6/2011 Wesson ..... B66B 1/302 700/275
2012/0019141 A1 * 1/2012 Beignet ..... B66B 5/02 315/76
2012/0085593 A1 * 4/2012 Schoenauer ..... B66B 5/027 187/254
2012/0261217 A1 10/2012 Agirman et al.
2015/0192906 A1 * 7/2015 Rogers ..... B66B 13/22 700/19
2016/0194180 A1 * 7/2016 Kubota ..... B66B 1/32 187/277
2017/0005562 A1 * 1/2017 Agirman ..... B66B 1/302
2017/0029242 A1 * 2/2017 Agirman ..... B66B 1/302
2017/0107077 A1 * 4/2017 Prakash ..... B66B 5/027

OTHER PUBLICATIONS

International Preliminary Report on Patentability application PCT/US2015/021965, dated Sep. 27, 2016, 7 pages.
Chinese First Office Action and Search Report for application 201580015927.5, dated Apr. 2, 2018, 12 pages.

* cited by examiner

JOLT-FREE ELEVATOR POWER TRANSITION

BACKGROUND

In a given elevator system or environment, primary power to the elevator may cease to exist due to a power outage of the primary power source or due to loss of one or more phases in a 3 phase 4 wire system. When the primary power becomes unavailable, fully or partially, a brake may be engaged and the elevator may come to a halt within a short amount of time (e.g., 200 milliseconds). This quick halt may cause a "jerking" or "jolting" sensation to be experienced by passengers of the elevator, which may cause the passengers to become frightened.

Upon the unavailability of the primary power, passengers within the elevator may need to be rescued using a so-called automatic rescue operation (ARO) device. For the ARO device to become operational as applied to the elevator, a restart may be necessary following the halting/jerking of the elevator, a direction of movement (e.g., up or down) may need to be selected, and then the elevator may be taken to the nearest landing. Once the elevator arrives at the nearest landing, the elevator doors may be opened to allow the passengers to exit. There may be appreciable delay experienced between the halting/jerking of the elevator until the elevator begins to move towards the nearest landing. This delay may cause passenger discomfort and potentially further anxiety or panic in the passengers.

BRIEF SUMMARY

An embodiment of the disclosure is directed to a system comprising: a converter configured to supply power to a motor of an elevator, a first power source coupled to the converter and configured to provide input power to the converter, and a second power source selectively coupled to the converter and configured to provide input power to the converter when power from the first power source is unavailable and when an elevator car of the elevator is moving, wherein a speed of the elevator car remains substantially constant when a transition in terms of the input power to the converter is made from the first power source to the second power source.

An embodiment of the disclosure is directed to a method comprising: powering, by a circuit, an elevator using power from a first power source, and powering, by the circuit, the elevator using power from a second power source based on determining that power from the first power source is available in an amount less than a threshold, wherein a speed of an elevator car associated with the elevator remains substantially constant when a transition in terms of input power to the elevator is made from the first power source to the second power source.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
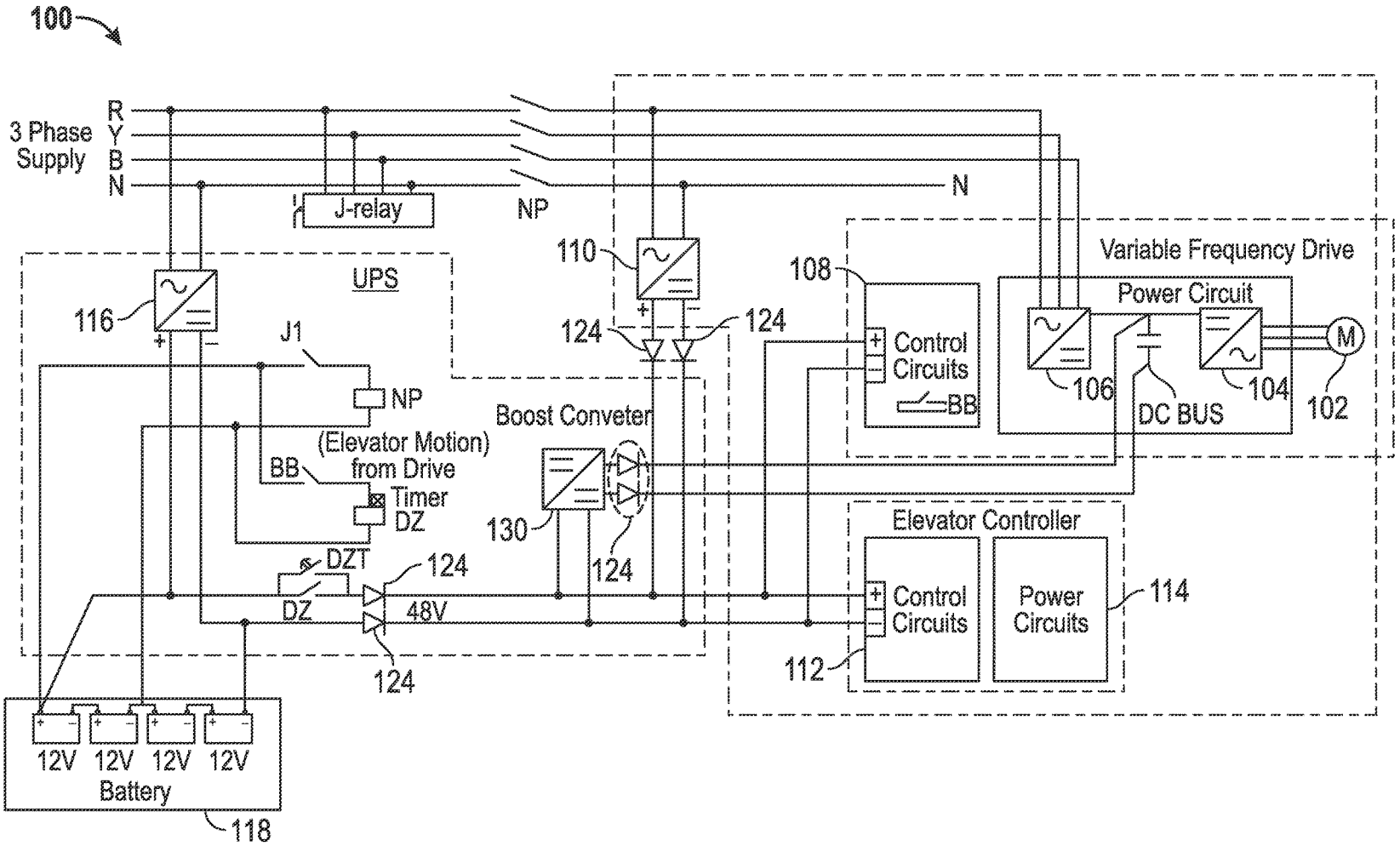
FIG. 1 illustrates an exemplary circuit diagram.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems and methods are described for safely and effectively controlling an elevator. In some embodiments, when power from a primary power source is unavailable, the elevator may complete a run using power obtained from a secondary power source, such as one or more batteries. The transition from the primary power source to the secondary power source may be seamless, such that passengers riding the elevator might not perceive any change in the motion or movement of the elevator during the transition.

Referring to FIG. 1, a diagram of a circuit 100 is shown. The circuit 100 may be associated with one or more conveyance devices, such as an elevator.

The elevator may be associated with a variable frequency drive (VFD). The VFD may include a motor (M) 102, which may be used to propel or move the elevator. The VFD may include a power circuit. For example, the power circuit may include a converter 104, which may convert input DC power into AC power for use by the motor 102. The power circuit may include a converter 106, which may convert input AC power into DC power for use by the converter 104. The input AC power to the converter 106 may be derived from, or obtained from, a primary power source, such as 3-phase supply (RYBN in FIG. 1).

When power from the primary power source is available, one or more control circuits 108 included in the VFD may be (DC) powered from the primary power source by way of a (AC to DC) converter 110. The control circuits 108 may be responsible for overseeing the efficient operation of the elevator. For example, the control circuit 108 may read or determine a position of the elevator based on one or more outputs from, e.g., an encoder (not shown). The control circuits 108 may also be responsible for implementing a so-called S-curve that provides for a soft starting and stopping motion of the elevator to provide comfort to passengers during acceleration and deceleration of the elevator.

The converter 110 may supply (DC) power to one or more control circuits 112 of an elevator controller. The control circuits 112 may provide one or more functions, such as facilitating call button operations, fireman operations, etc. The elevator controller may include one or more power circuits 114. The power circuits 114 may be used to facilitate functionality of the elevator. For example, the power circuits 114 may include one or more relays, a power supply circuit to facilitate, e.g., operation of the doors of the elevator, etc.

Also, when power from the primary power source is available, an AC to DC converter 116 may be used to supply power to charge one or more batteries 118. For example, FIG. 1 shows four batteries 118, where each battery 118 is configured to provide 12V nominally. Other voltage values may be used in some embodiments.

If all three phases of the primary power source are available, then the J-relay may energize. J-relay contact J1 may energize a power contactor NP, which may make three-phase utility power available to the VFD and DC power available to the control circuits 108 and 112. When elevator service is requested (e.g., a call is made by a passenger), the elevator may start moving and a status signal (e.g., an 'elevator is in motion signal') from the VFD may turn on a BB relay. The BB relay may remain on as long as the drive is not at zero speed. The turning on of the BB relay may, in turn, energize a power contactor DZ and a timer contactor DZT, thereby making power from the battery 118 available as standby or backup power. While a battery 118 is shown, any source of secondary power may be used.

The standby power derived from the battery 118 is lower than the voltages produced using the primary power source when present. This level difference in voltage isolates the primary power from the standby power. The diodes 124 shown in FIG. 1 prevent the flow of standby power to the VFD and Elevator controller when primary power is present. Standby power is only used/consumed when power from the primary source is unavailable. Standby or secondary power may always be present to ensure a seamless transition from primary power to secondary power, which may prevent a brake of the elevator from dropping or being engaged.

In some embodiments, in the event that power from the primary source becomes unavailable when the elevator is not in motion (e.g., is at rest), one or more of the control circuits 108 and 112 may dictate that the elevator should not be operated until power from the primary source is restored.

In some embodiments, in the event that power from the primary power source becomes unavailable when the elevator is in motion, the J-relay may drop or be de-energized and the NP contactor may open. Standby power from the batteries 118 may become available to power the control circuits 108 and 112 and the converter 104 (potentially via a boost converter 130, which may serve to increase the voltage provided to the converter 104 from the batteries 118) via the diodes 124. The BB relay may be on, as the elevator is in motion, and the power contactor DZ may be on through the BB relay. The power contactor DZ, which may be rated for handling high currents (e.g., current in an amount exceeding a threshold), may help to keep the elevator in motion until it reaches the desired next landing (e.g., zero speed).

Once at that next landing, the control circuit 108 may change the state of the status signal such that the BB relay may be turned off and the power contactor DZ may be de-energized. The timer contactor DZT may remain on for a pre-set amount of time to keep the elevator powered to enable the doors of the elevator to be opened.

The timer contactor DZT may open after sufficient time has lapsed to ensure that the elevator doors are opened (e.g., fully opened). Opening of the DZT contactor may disconnect or decouple the battery 118 from the elevator. The elevator may remain off until primary power is next available.

In some embodiments, if power from the primary power source (e.g., three-phase power/missed phase) becomes available at any point after it became unavailable, the elevator may be switched from operating off of the standby power (e.g., batteries 118) to operating off of the primary power. Passengers riding in the elevator might not even be cognizant of the fact that the elevator was operating off of the standby power.

Figure 2A:
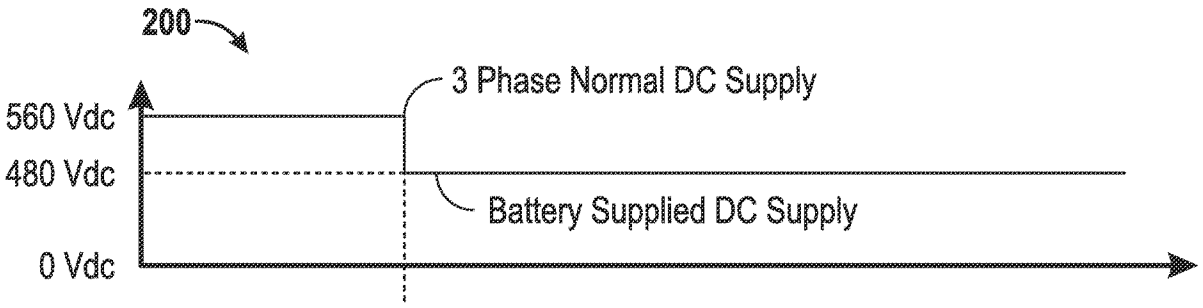
FIG. 2 illustrates a set of timing diagrams.
Figure 2B:
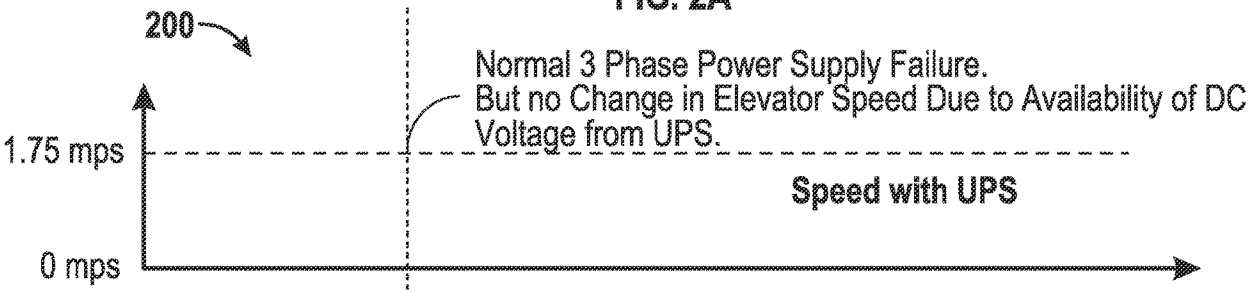
Figure 2C:
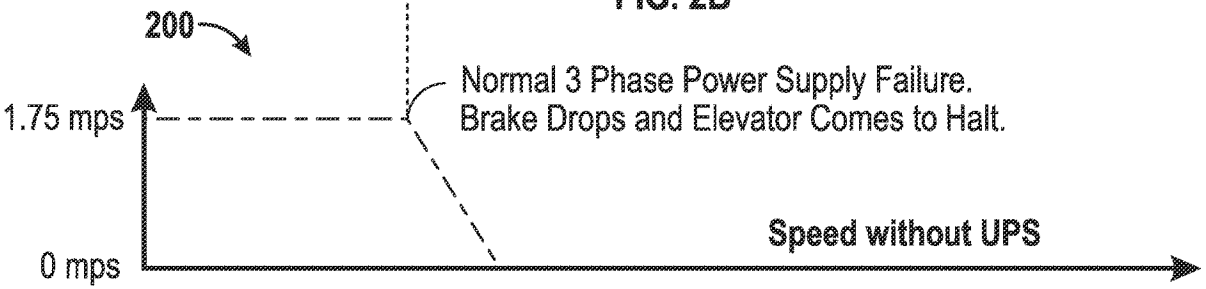

Referring now to FIG. 2, a set of timing diagrams 200 is shown. A first of the set of timing diagrams 200, labeled (A), corresponds to a plot of DC voltage supplied to, e.g., the converter 104 over the course of time. A second of the set of timing diagrams 200, labeled (B), corresponds to a plot of elevator speed over the course of time based on the circuit 100 of FIG. 1. A third of the set of timing diagrams 200, labeled (C), corresponds to a plot of elevator speed over the course of time based on a conventional elevator system.

The dashed vertical line connecting the timing diagrams (A), (B), and (C) in FIG. 2 may correspond to an instant in time when power from a primary power source (e.g., 3-phase power) becomes unavailable in an amount less than a threshold. As shown in timing diagram (A), when primary power is unavailable, the voltage supplied to the elevator/converter 104 may change from a first level (e.g., 560V) to a second level (e.g., 480V), where the second level may correspond to voltage provided by a secondary power source (e.g., batteries 118). The elevator/converter 104 may be configured to operate at both the first level and the second level.

As shown in timing diagram (B), the speed of the elevator may be approximately constant (e.g., at 1.75 meters per second (mps)) both before and after the unavailability of power from the primary power source, such that passengers riding in the elevator might not experience any change in motion. Conversely, as shown in timing diagram (C), the speed of the elevator may decrease when the power from the primary power source becomes unavailable, such that passengers may feel a jolt or jerk as a brake of the elevator brings the elevator to a halt (e.g., elevator speed=0 mps) within a short amount of time (e.g., 200 ms).

Figure 3:
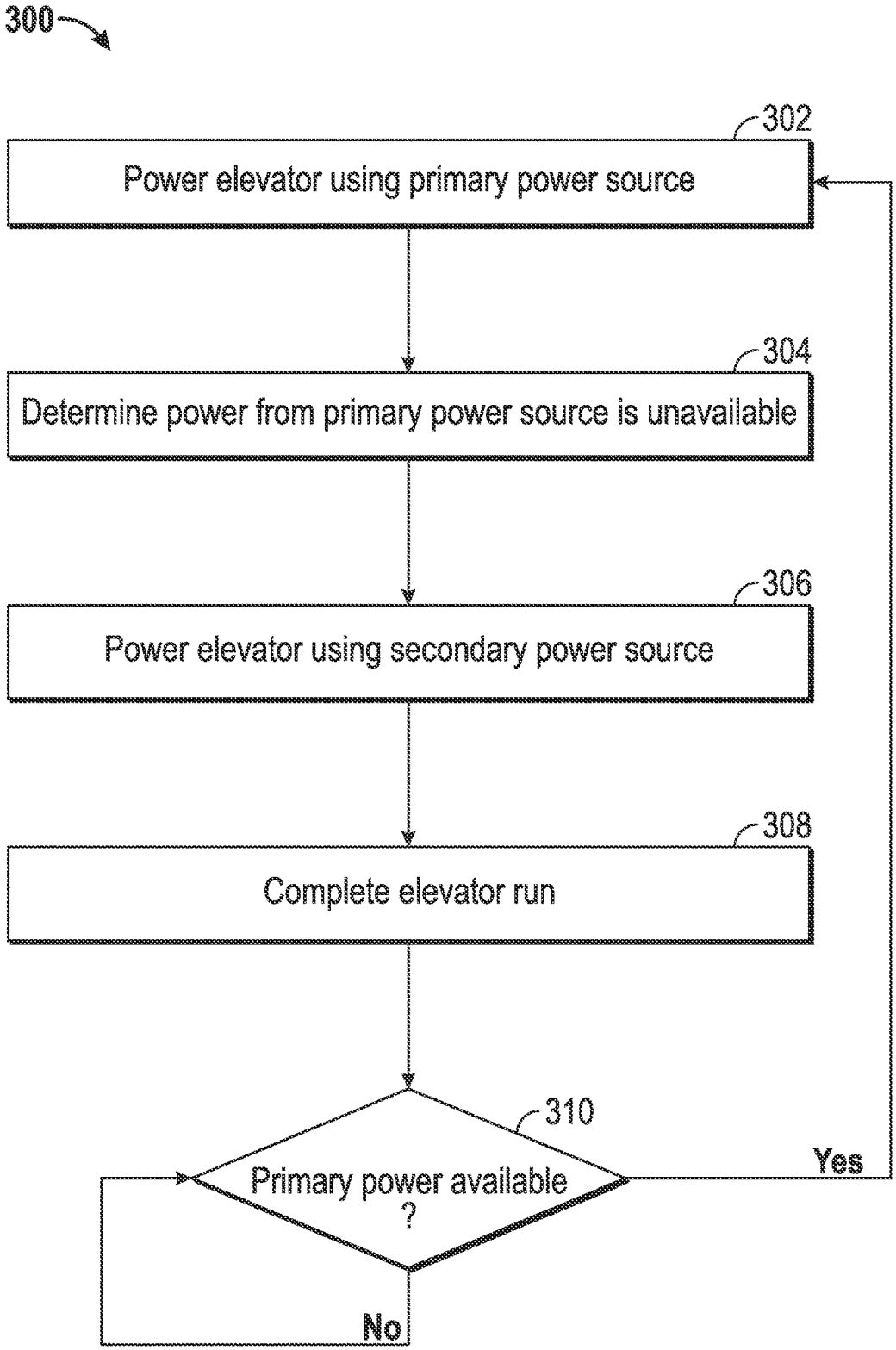
FIG. 3 illustrates a flow chart of an exemplary method.

Referring to FIG. 3, a flow chart of a method 300 is shown. The method 300 may be executed by one or more systems, components, or devices, such as those described herein. The method 300 may be used to select a power source to power an elevator.

In block 302, the elevator may be powered by a primary power source, such as a three-phase power source. While the elevator is being powered by the primary power source, a secondary power source (e.g., a battery) may be charged using power supplied by the primary power source. As part of block 302, the elevator may accept requests for service from passengers. For example, the elevator may function normally by taking passengers to requested floors or landings of a building.

In block 304, a determination may be made that the primary power source is unavailable. For example, at part of block 304, a monitoring or sensing component/device may detect that power from the primary power source is less than a threshold.

In block 306, the elevator may be powered from the secondary power source based on the determination of block 304. As part of block 306, the elevator might not receive any additional requests for service from passengers.

In block 308, a current run of the elevator may be completed using power provided by the secondary power source. The run may be completed by taking the passengers currently located within the elevator/elevator car to their selected destination floors/landings.

In block 310, a determination may be made whether power from the primary power source is available once again (e.g., if power from the primary power source is available in an amount greater than a threshold). If so, (e.g., the "Yes" path is taken out of block 310), flow may proceed to block 302. Otherwise (e.g., the "No" path is taken out of block 310), flow may remain at block 310 and the elevator may be out of service.

The method 300 is illustrative. In some embodiments, one or more of the blocks or operations (or portions thereof) may be optional. In some embodiments, the operations (or portions thereof) may execute in an order or sequence different from what is shown. In some embodiments, additional operations not shown may be included.

In some embodiments, rather than completing an elevator run by taking passengers to their requested floors/landings when operating using power from a secondary power source, the elevator may be commanded to travel to the next or nearest floor/landing. Doing so may enable the elevator system to be outfitted with a smaller secondary power source.

In some embodiments, a capacity of a secondary power source may be sized or selected to enable one round of call completion. Calls might not be taken once the elevator reaches the ground floor.

In some embodiments, when an elevator is operating using power from a secondary power source, the elevator may operate at a reduced speed in order to reduce the power required from the secondary power source.

As described herein, a transition of power to an elevator from a primary power source to a secondary power source, and from the second power source back to the primary power source, may be made seamlessly. For example, passengers of the elevator might not even be aware that a change in the power source has been made, such that passenger anxiety levels might not be raised. Furthermore, in the event that power from a primary power source becomes unavailable, a secondary power source may be used to complete a run of the elevator to enable passengers to exit the elevator.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. In some embodiments, one or more input/output (I/O) interfaces may be coupled to one or more processors and may be used to provide a user with an interface to an elevator system. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A system comprising:

a converter configured to supply power to a motor of an elevator;

a control circuit configured to control the converter;

a first power source coupled to the converter and configured to provide input power to the converter; and a second power source selectively coupled to the converter and configured to provide input power to the converter when power from the first power source is unavailable and when an elevator car of the elevator is moving, wherein a speed of the elevator car remains substantially constant when a transition in terms of the input power to the converter is made from the first power source to the second power source;

wherein when power from the first power source is unavailable, the second power source provides power to the control circuit;

a boost converter connecting the second power source to a DC bus of the converter.

2. The system of claim 1, wherein the first power source comprises a three-phase power source, and wherein the second power source comprises at least one storage device.

3. The system of claim 1, wherein the second power source provides a voltage that is less than a voltage provided by the first power source.

4. The system of claim 1, wherein second power source is configured to be charged by the first power source when power from the first power source is available.

5. The system of claim 1, wherein a capacity of the second power source is sized to enable the elevator car to complete a run of requested service when power from the first power source becomes unavailable.

6. The system of claim 1, wherein a capacity of the second power source is sized to enable the elevator car to stop at a landing that is nearest the location of the elevator car when power from the first power source becomes unavailable.

7. The system of claim 1, further comprising:

a contactor configured to couple power from the second power source to the converter while the elevator car is moving and until the elevator car stops.

8. The system of claim 7, further comprising:

a second contactor configured to couple power from the second power source to the converter for a predetermined amount of time after the elevator car stops.

9. The system of claim 8, wherein the predetermined amount of time is selected to enable doors of the elevator car to open after the elevator car stops.

10. The system of claim 1, wherein the first power source provides a first voltage and the second power source provides a second voltage lower than the first voltage, the first voltage isolating the second voltage from the converter when the first voltage is available and the second voltage being coupled to the converter when the first voltage is unavailable.

11. A method comprising:

powering, by a circuit, an elevator using power from a first power source; and powering, by the circuit, the elevator using power from a second power source based on determining that power from the first power source is available in an amount less than a threshold, wherein a speed of an elevator car associated with the elevator remains substantially constant when a transition in terms of input power to the elevator is made from the first power source to the second power source;

subsequent to the power from the first power source being available in the amount less than the threshold, determining, by the circuit, that the power from the first power source is available in an amount greater than a second threshold; and based on determining that the power from the first power source is available in the amount greater than the second threshold, powering, by the circuit, the elevator using power from the first power source, wherein the speed of the elevator car remains substantially constant when a transition in terms of input power to the elevator is made from the second power source to the first power source;

wherein the threshold and the second threshold are different thresholds, and wherein the second threshold is greater than the threshold.

12. The method of claim 11, further comprising:

charging the second power source by the first power source when power from the first power source is available; and isolating the second power source and the first power source when the power from the first power source is available in the amount less than the threshold.

13. The method of claim 11, further comprising:

sizing a capacity of the second power source to enable the elevator car to complete a run of requested service when power from the first power source is available in the amount less than the threshold.

14. The method of claim 11, further comprising:

sizing a capacity of the second power source to enable the elevator car to stop at a landing that is nearest the location of the elevator car when power from the first power source is available in the amount less than the threshold.

15. The method of claim 11, further comprising:

coupling power from the second power source to the elevator via a contactor while the elevator car is moving and until the elevator car stops.

16. The method of claim 15, further comprising:

coupling power from the second power source to the elevator via a second contactor for a predetermined amount of time after the elevator car stops.

17. The method of claim 16, further comprising:

selecting the predetermined amount of time to enable doors of the elevator car to open after the elevator car stops.

18. A system comprising:

a converter configured to supply power to a motor of an elevator;

a control circuit configured to control the converter;

a first power source coupled to the converter and configured to provide input power to the converter; and a second power source selectively coupled to the converter and configured to provide input power to the converter when power from the first power source is unavailable and when an elevator car of the elevator is moving, wherein a speed of the elevator car remains substantially constant when a transition in terms of the input power to the converter is made from the first power source to the second power source;

wherein when power from the first power source is unavailable, the second power source provides power to the control circuit;

a diode connecting the second power source to the converter, a second voltage connected to an anode of the diode, a first voltage coupled to a cathode of the diode, wherein the first voltage is greater than the second voltage.

19. A system comprising:

a converter configured to supply power to a motor of an elevator;

a control circuit configured to control the converter;

a first power source coupled to the converter and configured to provide input power to the converter;

a second power source selectively coupled to the converter and configured to provide input power to the converter when power from the first power source is unavailable and when an elevator car of the elevator is moving, wherein a speed of the elevator car remains substantially constant when a transition in terms of the input power to the converter is made from the first power source to the second power source;

wherein when power from the first power source is unavailable, the second power source provides power to the control circuit;

a diode connecting the second power source to the control circuit, a second voltage connected to an anode of the diode, a first voltage coupled to a cathode of the diode, wherein the first voltage is greater than the second voltage.

* * * * *